US005567054A

United States Patent [19]

Dalgleish

[11] Patent Number: 5,567,054

[45] Date of Patent: Oct. 22, 1996

[54] ILLUMINATED BAG

[76] Inventor: Rick Dalgleish, 14 Pine St., Sherwood Park, Edmonton, Alberta, Canada, T8A 1G5

[21] Appl. No.: 992,058

[22] Filed: Dec. 17, 1992

[51] Int. Cl.[6] ..... B65D 33/08; B65D 33/00

[52] U.S. Cl. ..... 383/10; 362/34; 362/156; 383/40; 383/106

[58] Field of Search ..... 383/10, 38, 40, 383/106; 362/34, 154, 156

[56] References Cited

U.S. PATENT DOCUMENTS

| | | | |
|---|---|---|---|
| D. 258,205 | 2/1981 | Kroll | D9/305 |
| 2,263,463 | 11/1941 | Johnston | 362/156 |
| 2,334,480 | 11/1943 | Cross | 362/156 |
| 4,698,732 | 10/1987 | Hickey | 362/156 |
| 4,714,985 | 12/1987 | Hickey | 362/154 |
| 4,720,040 | 1/1988 | Gurowitz | 383/38 |
| 4,751,616 | 6/1988 | Smithey | 362/34 |
| 4,802,071 | 1/1989 | Schuster | 362/154 |
| 4,926,296 | 5/1990 | Blume et al. | 362/156 |
| 4,963,117 | 10/1990 | Gualdoni | 446/219 |

*Primary Examiner*—Stephen P. Garbe
*Attorney, Agent, or Firm*—Eugene J. A. Gierczak

[57] ABSTRACT

An illuminated bag having an open end and a closed end, a transparent pouch associated with the closed end, and chemiluminescent wand disposed within the pouch for illumination upon activating the chemiluminescent wand.

8 Claims, 1 Drawing Sheet

ILLUMINATED BAG

FIELD OF INVENTION

This invention relates to an illuminated bag having a chemiluminescent wand and particularly relates to an illuminated bag for receiving halloween treats.

BACKGROUND OF THE INVENTION

Various attempts have heretofore been made in order to provide bags or containers which include a light source in order to announce the presence of individuals who are travelling at night. These illuminating devices may be used in a variety of situations but are particularly important at halloween when small children are travelling from door to door at night.

For example, U.S. Pat. No. 4,802,071 teaches a battery powered lantern which is used by a child to collect halloween treats where the outer shell simulates a jack-o-lantern and improves the child's ability to see and to be seen at night.

Moreover, U.S. Pat. No. 4,698,732 teaches a bucket shaped container which has an open top for collecting items and a bottom portion for receiving a light such as a flash light. The flash light is held in position by a press fit against the edge of the opening and extends between the interior and exterior of the container.

Moreover, U.S. Pat. No. 5,143,440 relates to a lunch pail wherein the lunch pail box includes an upper housing pivotly mounted to a lower housing with the illumination chamber positioned on the top wall of the upper housing. Moreover, U.S. Pat. No. 607,897 relates to a flexible bag having a closed end and an open end with a transverse case connected at the closed end of the bag and providing with a slot or opening in one side thereof wherein such slot or opening is adapted to be closed by the bag when the later is rolled around the case.

Furthermore, U.S. Pat. No. 2,334,680 relates to a purse which has a light source along the bottom thereof.

Moreover, chemiluminescent wands have heretofore been used in order to provide light by means of mixing two chemicals. For example, U.S. Pat. No. 3,576,987 illustrates a chemiluminescent wand having a first chemical in an inner frangible tube and a second chemical in an outer flexible casing which encompasses the inner tube wherein the chemicals when mixed by deforming the outer casing and fracturing the inner to generate a chemiluminescent.

Such chemiluminescent wands have been used to provide luminescent fishing lures as disclosed in U.S. Pat. No. 3,861,071 as well as illuminated under water writing tablets as shown in U.S. Pat. No. 5,083,242.

It is an object of this invention to provide an improved illuminated bag which includes a chemiluminescent wand so as to enhance the visibility of a user at night and particularly relates to an improved halloween container.

It is an aspect this invention to provide a bag with a chemiluminescent wand for illuminating said bag, said bag having: an open top end and sealed bottom end and sealed opposite side ends; a transparent pouch spaced substantially parallel from one of said sealed ends, an opening into said pouch, said chemiluminescent wand disposed within said pouch for illumination upon activating said chemiluminescent wand.

It is a further aspect of this invention to provide a bag for receiving halloween treats said bag having a chemiluminescent wand for illuminating said bag comprising: a folded web of transparent material presenting a folded closed bottom and an open top with sealed opposite side ends thereof defining said bag for receiving said treats; a bottom seal spaced substantially parallel from said folded bottom defining a pouch; an opening into said pouch for receiving said chemiluminescent wand within said pouch, said chemiluminescent wand having a first chemical in an inner frangible tube and a second chemical in an outer flexible casing encompassing said inner tube, wherein said chemicals when mixed by deforming said outer casing and fracturing said inner tube generate a chemiluminescent so as to illuminate said bag.

DESCRIPTION OF THE DRAWINGS

These and other objects and features of the invention shall now be described in relation to the following drawings.

DESCRIPTION OF THE INVENTION

Like parts will be given numbers throughout the figures.

Figure 1:
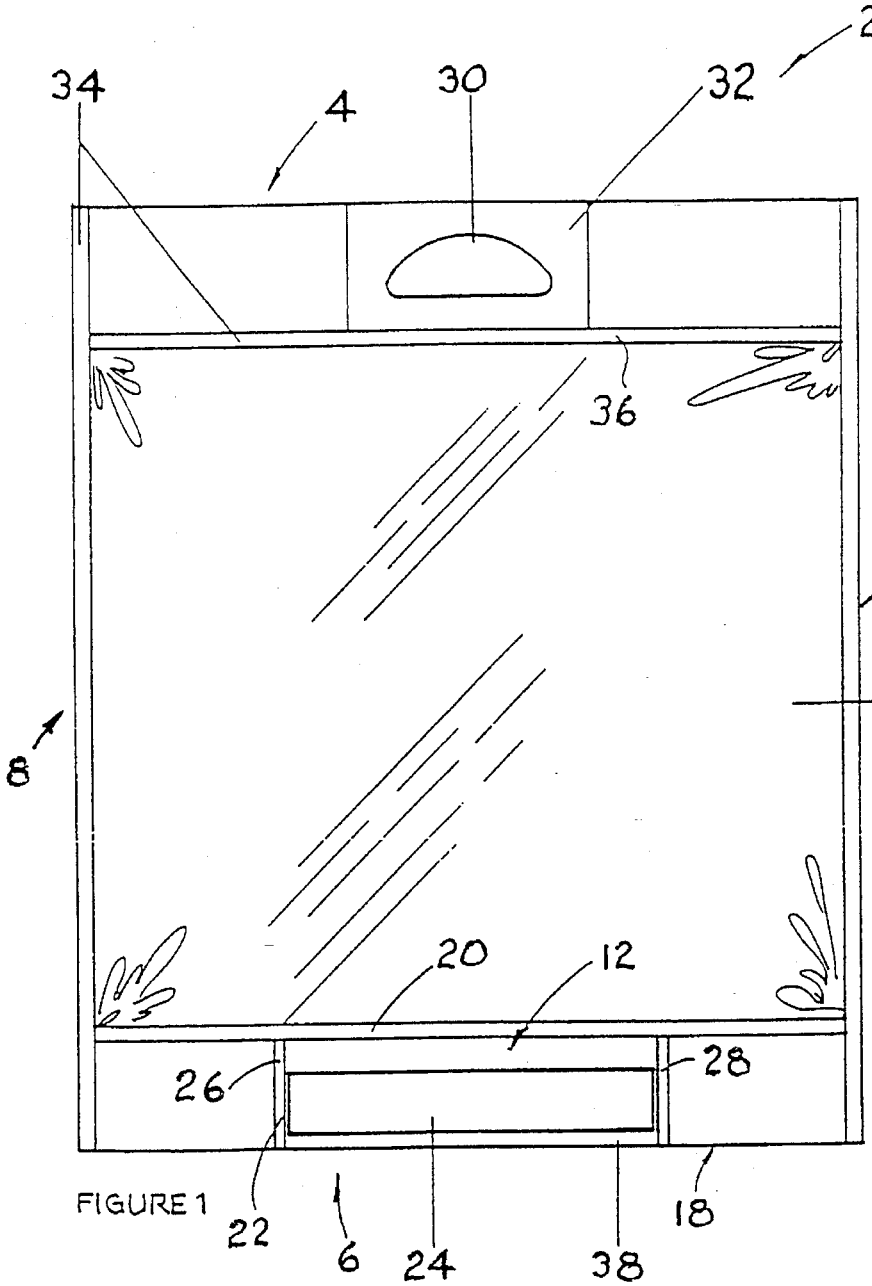
FIG. 1 is a front elevational view of the illuminated bag.

FIG. 1 generally illustrates the illuminated bag 2 which has an open end 4 and a closed end 6 and two opposite side ends 8 and 10, respectively. One of the ends has associated therewith a pouch 12. In the embodiment described in FIGS. 1 and 2 the pouch 12 is associated with the bottom end 6 although the pouch 12 in accordance with the invention herein could also be associated with either of the side ends 8 or 10.

Figure 2:
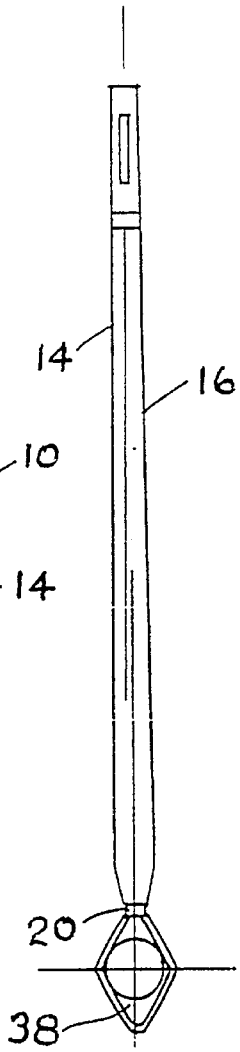
FIG. 2 is a side elevational view of the illuminated bag.

In the embodiment shown in FIG. 1 and 2 the bag 2 presents a front panel 14 and a rear panel 16. In particular, the bag 2 as shown in FIGS. 1 and 2 comprises a folded web of transparent material which presents a folded closed bottom 18 and open top 4 with sealed opposite sides 8 and 10 thereof defining the bag for receiving halloween treats.

The bag 2 also includes a bottom seal 20 which is spaced substantially parallel from the folded bottom 18 for defining a pouch 12.

The web transparent material can comprise of plastic or the like. The side ends 8 and 10 and bottom seal 20 are produced in a manner well known to those persons skilled in the art by means of heat sealing or the like so as to join the front and rear panels 14 and 16 to define the bag 2.

The pouch 12 will include an opening 22 for inserting the chemiluminescent wand 24 within the pouch. The pouch 12 may have the opening 22 heat sealed closed as illustrated at 26 or such opening 22 may be left open. Alternatively the wand 24 may be inserted in an opening 38 as illustrated in FIG. 2. The opening 38 would be provided prior to heat sealing the pouch 12. In other words, one side 10 is heat sealed all the way down the side, while the other side 8 would be heat sealed, but the heat sealing would stop at the pouch 12, such that openings 38 would be provided to receive the wand 12. Thereafter the wand 12 would be heat sealed in.

The pouch 12 may also includes opposite seals 26 and 28 which are substantially parallel to the side seals 8 and 10, respectively so as to securely retain the chemiluminescent wand 24 within the pouch 12. The upper end 4 also includes a handle 30 which may be reinforced by material 32.

Moreover, the handle area may be comprises of a double layer of transparent web material which is folded over at 36 and then heat sealed as represented by numeral 34 so as to increase the carrying capacity of the handle.

Accordingly, the user of the bag 2 may use the bag in a conventional manner and when in use at night the user may activate the chemiluminescent wand 24 so as to enhance the visibility of the transparent pouch 12 as well as the user of the bag 2.

In particular, the chemiluminescent wand has a first chemical and an inner frangible tube and a second chemical in an outer flexible casing which encompasses the inner tube wherein the chemicals when mixed by deforming the outer casing and fracturing the inner tube generate a chemiluminescent.

Therefore, the bag 2 as described herein is well suited for use at halloween when children go door to door to pick up the treats. Accordingly, the chemiluminescent wand in the bag 2 may be activated so as to generate an illumination which will enhance the safety of the child since the chemiluminescent wand will light up the area around the child as well as announce the presence of the child to passing vehicles.

Although the preferred embodiment as well as the operation and use have specifically been described in relation to the drawings, it should be understood the variations in the preferred embodiment could be achieved by a man skilled in the art without departing from the spirit of the invention. Accordingly, the invention should not be understood to be limited to the exact form revealed by the drawings.

The embodiments of the invention in which an exclusive property or privilege is claimed are defined as follows:

1. A bag with a chemiluminescent wand for illuminating said bag, said bag having: an open top end and sealed bottom end and sealed opposite side ends; a transparent pouch spaced substantially parallel from one of said sealed ends, an opening into said pouch, said chemiluminescent wand disposed within said pouch for illumination upon activating said chemiluminescent wand.

2. A bag as claimed in claim 1 wherein said pouch is disposed adjacent one of said side ends.

3. A bag as claimed in claim 1 wherein said pouch is disposed adjacent said bottom end.

4. In an illuminated bag as claimed in claim 3 wherein said top includes handles.

5. In an illuminated bag as claimed in claim 4 wherein said bag comprises transparent plastic material.

6. A bag for receiving halloween treats said bag having a chemiluminescent wand for illuminating said bag comprising:

(a) a folded web of transparent material presenting a folded closed bottom and an open top with sealed opposite side ends thereof defining said bag for receiving said treats;

(b) a bottom seal spaced substantially parallel from said folded bottom defining a pouch;

(c) an opening into said pouch for receiving said chemiluminescent wand within said pouch, said chemiluminescent wand having a first chemical in an inner frangible tube and a second chemical in an outer flexible casing encompassing said inner tube, wherein said chemicals when mixed by deforming said outer casing and fracturing said inner tube generate a chemiluminescent so as to illuminate said bag.

7. A bag as claimed in claim 6 wherein said upper end includes handles.

8. A bag as claimed in claim 2 wherein said pouch is disposed adjacent one of said closed sides.

* * * * *